US011459731B2

(12) United States Patent
Fukuda et al.

(10) Patent No.: US 11,459,731 B2
(45) Date of Patent: Oct. 4, 2022

(54) WORKING MACHINE

(71) Applicant: KUBOTA CORPORATION, Osaka (JP)

(72) Inventors: Yuji Fukuda, Osaka (JP); Ryota Hamamoto, Osaka (JP); Jun Tomita, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/077,341

(22) Filed: Oct. 22, 2020

(65) Prior Publication Data

US 2021/0123214 A1 Apr. 29, 2021

(30) Foreign Application Priority Data

Oct. 28, 2019 (JP) ..... JP2019-195517
Oct. 28, 2019 (JP) ..... JP2019-195518

(51) Int. Cl.
*E02F 9/22* (2006.01)

(52) U.S. Cl.
CPC ..... *E02F 9/2246* (2013.01); *E02F 9/2203* (2013.01); *E02F 9/2253* (2013.01); *E02F 9/2278* (2013.01)

(58) Field of Classification Search
CPC ..... E02F 9/2246; E02F 9/2253
See application file for complete search history.

(56) References Cited

U.S. PATENT DOCUMENTS

2013/0136624 A1* 5/2013 Kitao ..... E02F 9/2289 417/212
2013/0256053 A1* 10/2013 Shirao ..... B60W 10/182 180/305
2014/0200775 A1* 7/2014 Shirao ..... E02F 9/2246 701/50
2017/0284063 A1* 10/2017 Fukuda ..... E02F 9/2253
2019/0352881 A1* 11/2019 Oasa ..... F16H 61/431
2020/0199850 A1* 6/2020 Oasa ..... E02F 9/2253
2020/0248436 A1* 8/2020 Hyodo ..... E02F 9/2246
2021/0140541 A1* 5/2021 Oasa ..... F16H 61/472

FOREIGN PATENT DOCUMENTS

JP 2017-179922 A 10/2017

* cited by examiner

*Primary Examiner* — Michael Leslie
*Assistant Examiner* — Matthew Wiblin
(74) *Attorney, Agent, or Firm* — Greenblum & Bernstein, P.L.C.

(57) ABSTRACT

A working machine includes a switching valve to switch between a first state and a second state, the first state allowing a revolving speed of a traveling motor to be a first speed, the second state allowing the revolving speed of the traveling motor to be a second speed, and a controller device to reduce the revolving speed of the prime mover in either acceleration to switch from the first state to the second state or deceleration to switch from the second state to the first state. The controller device associates a return timing with a switch timing in either the acceleration or deceleration, the return timing allowing an actual revolving speed of a prime mover to start returning toward a first target revolving speed after the actual revolving speed is reduced, the switch timing allowing the switching valve to switch to either an acceleration side or a deceleration side.

20 Claims, 7 Drawing Sheets

WORKING MACHINE

CROSS-REFERENCE TO RELATED APPLICATIONS

The present application claims priority under 35 U.S.C. § 119 to Japanese Patent Application No. P2019-195517, filed Oct. 28, 2019 and to Japanese Patent Application No. P2019-195518, filed Oct. 28, 2019. The contents of these applications are incorporated herein by reference in their entirety.

BACKGROUND OF THE INVENTION

Field of the Invention

The present invention relates to a working machine.

Description of Related Art

The technology for performing deceleration and acceleration in a working machine is shown in Japanese Unexamined Patent Application Publication No. 2017-179922. The hydraulic system for the working machine of Japanese Unexamined Patent Application Publication No. 2017-179922 is provided with a hydraulic pump to output hydraulic fluid, a hydraulic switching valve configured to be switched to a plurality of switching positions according to a pressure of the hydraulic fluid, and a traveling hydraulic system configured to change a speed according to the switching position of the hydraulic switching valve.

SUMMARY OF THE INVENTION

A working machine includes: a prime mover; a traveling pump to be activated by the prime mover and to output operation fluid; a traveling motor to be driven by the operation fluid outputted by the traveling pump and to switch a revolving speed between a first speed and a second speed higher than the first speed; a machine body on which the prime mover, the traveling pump, and the traveling motor are provided; a switching valve to switch between a first state and a second state, the first state allowing the revolving speed of the traveling motor to be the first speed, the second state allowing the revolving speed of the traveling motor to be the second speed, an accelerator to set a first target revolving speed of the prime mover; a revolving detector to detect an actual revolving speed of the prime mover; and a controller device to reduce the revolving speed of the prime mover in either acceleration to switch from the first state to the second state or deceleration to switch from the second state to the first state. The controller device associates a return timing with a switch timing in either the acceleration or the deceleration, the return timing allowing the actual revolving speed to start returning toward the first target revolving speed after the actual revolving speed is reduced, the switch timing to allow the switching valve to switch to either an acceleration side or a deceleration side.

A working machine includes: a prime mover; a traveling pump to be activated by the prime mover and to output operation fluid; a traveling motor to be driven by the operation fluid outputted by the traveling pump and to switch a revolving speed between a first speed and a second speed higher than the first speed; a machine body on which the prime mover, the traveling pump, and the traveling motor are provided; a switching valve to switch between a first state and a second state, the first state allowing the revolving speed of the traveling motor to be the first speed, the second state allowing the revolving speed of the traveling motor to be the second speed; an accelerator to set a first target revolving speed of the prime mover; a revolving detector to detect an actual revolving speed of the prime mover; and a controller device to set an instructed revolving speed for the prime mover to be a second target revolving speed lower than the first target revolving speed in either acceleration to switch from the first state to the second state or deceleration to switch from the second state to the first state. The controller device reduces the actual revolving speed to the second target revolving speed after the instructed revolving speed is set to a third target revolving speed that is lower than the first target revolving speed and higher than the second target revolving speed in a switch timing in either the acceleration or the deceleration.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
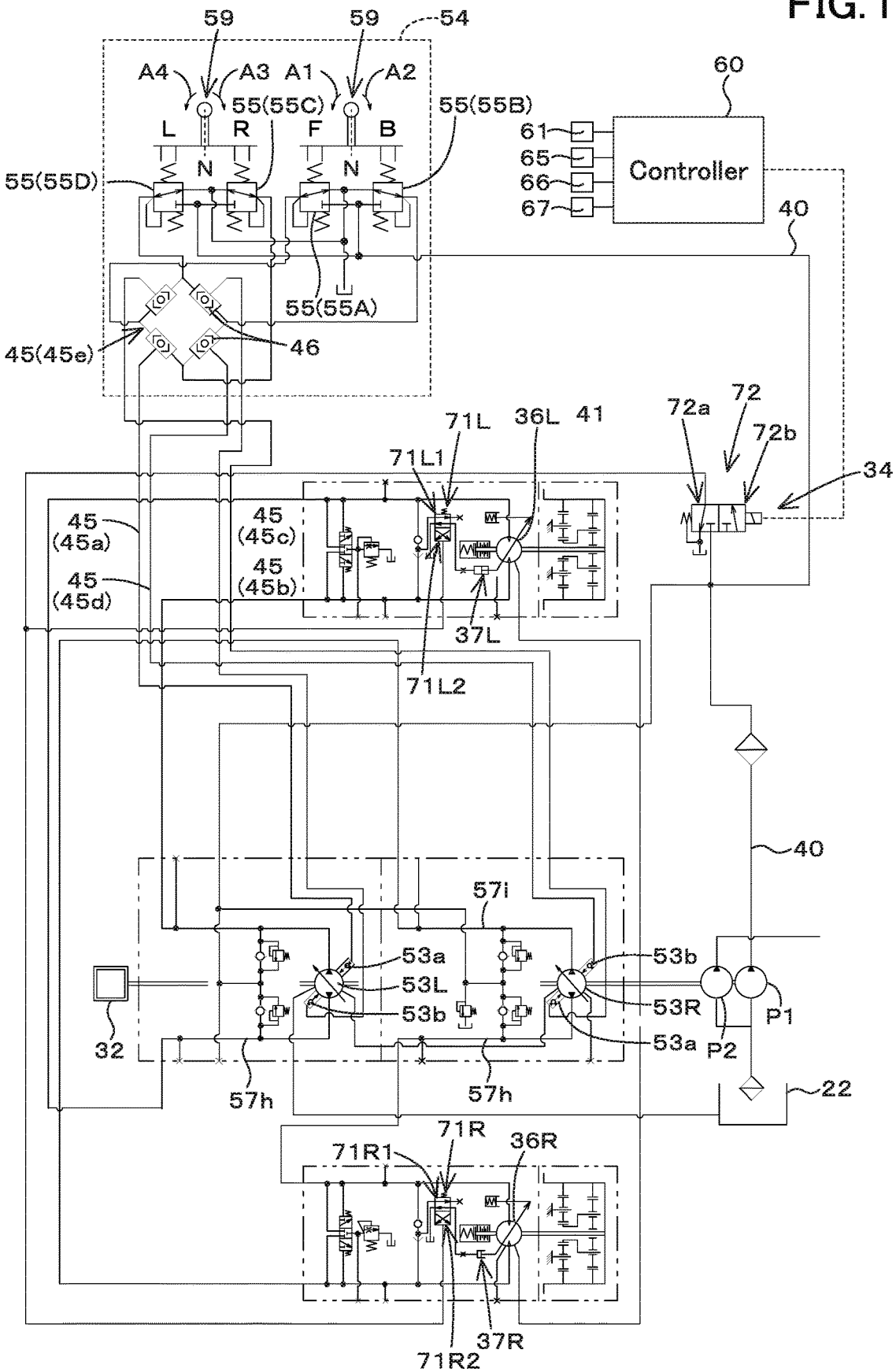
FIG. 1 is a view sowing a hydraulic system (hydraulic circuit) for a working machine according to a first embodiment.

The embodiments of the present invention will now be described with reference to the accompanying drawings, wherein like reference numerals designate corresponding or identical elements throughout the various drawings. The drawings are to be viewed in an orientation in which the reference numerals are viewed correctly.

A hydraulic system for a working machine and a preferred embodiment of a working machine provided with this hydraulic system will be described below with reference to the drawings as appropriate.

Figure 5:
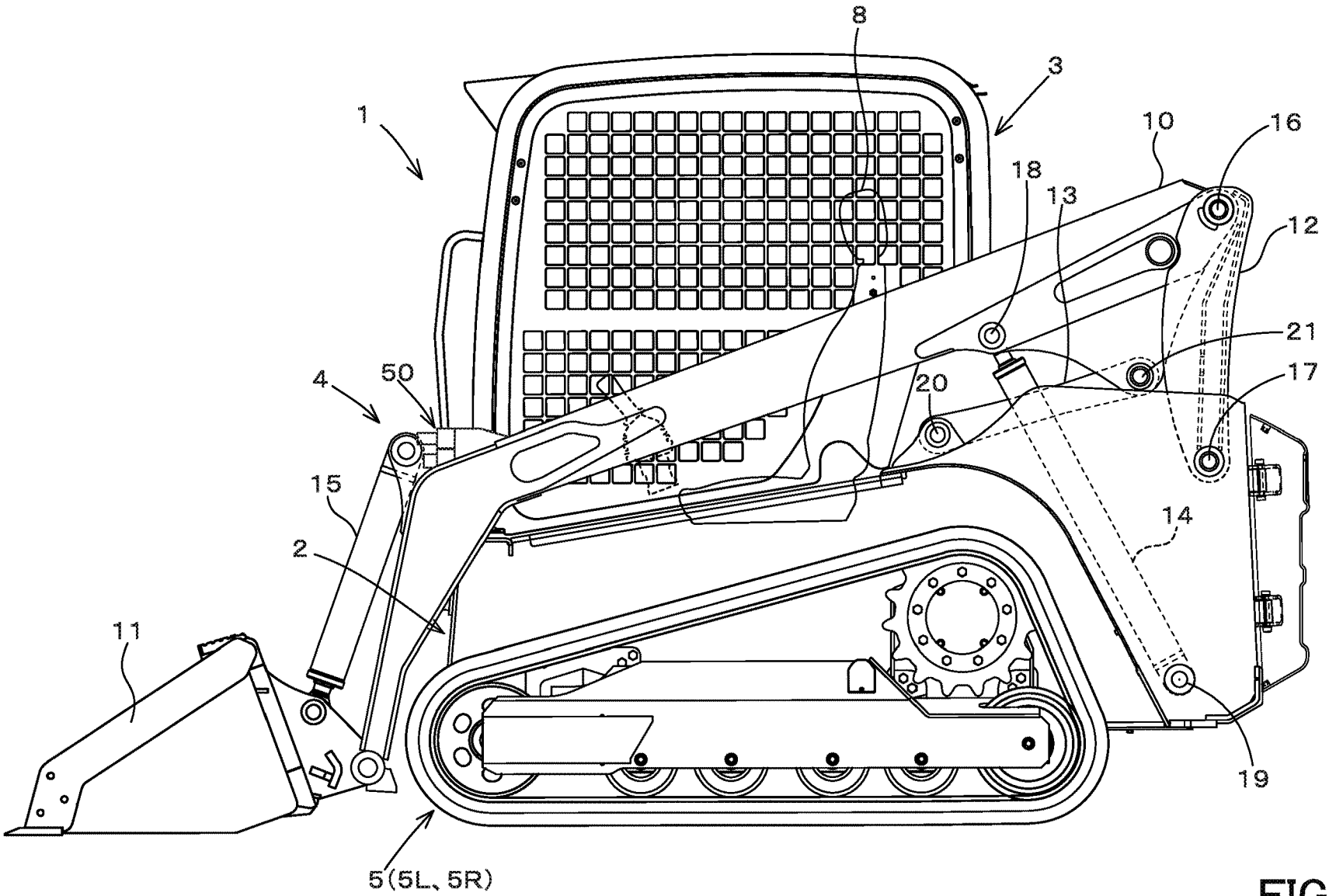
FIG. 5 is a side view showing a track loader as an example of a working machine.

FIG. 5 shows a side view of a working machine in accordance with the present invention. In FIG. 5, a compact track loader is shown as an example of a working machine. However, the working machine of the present invention is not limited to a compact track loader and may be other types of loader working machine, such as a skid steer loader, for example. It may also be a working machine other than a loader working machine.

As shown in FIG. 5, the working machine 1 is provided with a machine body 2, a cabin 3, a working device 4, and a traveling device 5. In the embodiment of the invention, the front side of the driver seated in the operator seat 8 of the working machine 1 (the left side of FIG. 5) is described as the front, the rear side of the driver (the right side of FIG. 5) is described as the rear, the left side of the driver (the front surface side of FIG. 5) is described as the left, and the right side of the driver (the back surface side of FIG. 5) is described as the right.

The horizontal direction, which is orthogonal to the front/rear direction, is described as a machine width direction. The direction from the center to the right or left of machine body 2 is described as a machine outward direction. In other words, the machine outward direction is the direction of the machine body width and away from the machine body 2. The direction opposite to the machine outward direction is described as a machine inward direction. In other words, the machine inward direction is the direction of the machine body width, which is closer to the machine body 2.

A cabin 3 is mounted on the machine body 2. The cabin 3 is provided with an operator seat 8. The working device 4 is mounted on the machine body 2. A travelling device 5 is provided on the outside of the machine body 2. A prime mover 32 is mounted at the rear inside the machine body 2. The traveling device 5 includes a first traveling device 5L provided on the left side of the machine body 2 and a second traveling device 5R provided on the right side of the machine body 2.

The working device 4 has a boom 10, a working tool 11, a lift link 12, a control link 13, a boom cylinder 14 and a bucket cylinder 15.

The boom 10 is pivotally provided on the right and left sides of the cabin 3 for vertical pivoting. The working tool 11 is, for example, a bucket, the bucket 11 being provided at the end (front end) of the boom 10 for vertical pivoting.

The lift link 12 and the control link 13 support the base (rear) of the boom 10 so that the boom 10 can be pivoted up and down freely. The boom cylinder 14 raises and lowers the boom 10 by extending and shortening. The bucket cylinder 15 pivots the bucket 11 by extending and shortening.

The front portions of each boom 10 on the left and right side are connected to each other by a deformed connecting pipe. The base (rear) of each boom 10 is connected to each other by a circular connecting pipe.

The lift links 12, the control links 13 and the boom cylinders 14 are provided on the left and right sides of the machine body 2, respectively, corresponding to each boom 10 on the left and right side.

A lift link 12 is provided vertically at the rear of the base of each boom 10. The upper portion (one end side) of the lift link 12 is pivoted freely around a horizontal axis via a pivot shaft 16 (pivot shaft) near the rear of the base of each boom 10.

The lower portion (the other end side) of the lift link 12 is pivoted freely around a horizontal axis via a pivot shaft 17 (pivot shaft) near the rear of the machine body 2. The pivot shaft 17 is provided below the pivot shaft 16.

The upper portion of the boom cylinder 14 is pivotally pivoted around a horizontal axis via a pivoting shaft 18 (pivot axis). The pivot shaft 18 is the base of each boom 10 and is located at the front of the base.

The lower portion of the boom cylinder 14 is pivoted freely around a horizontal axis via a pivot shaft 19 (pivot shaft). The pivot shaft 19 is located near the bottom of the rear of the machine body 2 and below the pivot shaft 18.

A control link 13 is provided in front of the lift link 12. One end of the control link 13 is rotatably pivoted around a horizontal axis via a pivot shaft 20 (pivot axis). The pivot shaft 20 is located on the machine body 2, corresponding to the front of the lift link 12.

The other end of the control link 13 is pivoted rotatably around a horizontal axis via a pivot shaft 21 (pivot axis). The pivot shaft 21 is a boom 10, which is provided in front of and above the pivot shaft 17.

By extending and shortening the boom cylinder 14, each boom 10 pivots up and down around the pivot shaft 16 while the base of each boom 10 is supported by the lift link 12 and the control link 13, and the tip of each boom 10 is raised and lowered.

The control link 13 pivots up and down around the pivot axis 20 with the vertical oscillation of each boom 10. The lift link 12 pivots back and forth around the pivot axis 17 with the vertical pivoting of the control link 13.

The front of the boom 10 can be fitted with another working tool in place of the bucket 11. Another working tool is, for example, a hydraulic crusher, a hydraulic breaker, an angle bloom, an earth auger, a pallet fork, a sweeper, a mower, a snow blower and other attachments (auxiliary attachments).

A connecting member 50 is provided at the front of the boom 10 on the left side. The connecting member 50 is a device that connects the hydraulic device on the auxiliary attachment to a pipe or other first pipe material on the boom 10.

In particular, a first tube material can be connected to one end of the connecting member 50, and a second tube material connected to the hydraulic device of the auxiliary attachment can be connected to the other end. As a result, the hydraulic fluid flowing through the first tube material passes through the second tube material and is supplied to the hydraulic device.

The bucket cylinders 15 are located near the front of each boom 10, respectively. By extending and shortening the bucket cylinders 15, the bucket 11 is pivoted.

For each of the left and right side traveling devices 5 (first traveling device 5L and second traveling device 5R), a crawler type (including a semi-crawler type) driving device is employed in this embodiment. A wheel-type driving device having a front wheel and a rear wheel may be employed.

The prime mover 32 is a diesel engine, an internal combustion engine such as a gasoline engine, an electric motor, and the like. In this embodiment, the prime mover 32 is a diesel engine, but is not limited thereto.

Next, the hydraulic system for the working machine will be explained.

As shown in FIG. 1, the hydraulic system for the working machine is capable of driving the traveling device 5. The hydraulic system for the working machine is provided with a first traveling pump 53L, a second traveling pump 53R, a first traveling motor 36L, and a second traveling motor 36R.

The first traveling pump 53L and the second traveling pump 53R are pumps driven by the power of the prime mover 32. In particular, the first traveling pump 53L and the second traveling pump 53R are swash plate type variable displacement axial pumps driven by the power of the prime mover 32.

The first traveling pump 53L and the second traveling pump 53R have a pressure receiver portion 53*a* for forward motion and a pressure receiver portion 53*b* for backward motion, wherein the angle of the swash plate is changed by the pilot pressure acting on the pressure receiver portions 53*a* and 53*b*.

By changing the angle of the swash plate, the output of the first traveling pump 53L and the second traveling pump 53R (the output amount of hydraulic fluid) and the outputting direction of the hydraulic fluid can be changed.

The first traveling pump 53L is connected to the first traveling motor 36L by means of a circulation fluid line 57*h*, and the hydraulic fluid output by the first traveling pump 53L is supplied to the first traveling motor 36L. The second traveling pump 53R is connected to the second traveling motor 36R by means of the circulation fluid line 57*i*, and the hydraulic fluid output by the second traveling pump 53R is supplied to the second traveling motor 36R.

The first traveling motor 36L is a motor that transmits power to the drive shaft of the driving device 5, which is located on the left side of the machine body 2. The first traveling motor 36L can be rotated by hydraulic fluid output from the first traveling pump 53L, and the revolutions speed (number of revolutions) can be changed according to the flow rate of the hydraulic fluid.

A swash plate switching cylinder 37L is connected to the first traveling motor 36L, and the revolutions speed (number of revolutions) of the first traveling motor 36L can also be changed by extending and shortening the swash plate switching cylinder 37L to one side or the other.

That is, when the swash plate switching cylinder 37L is shortened, the speed of the first traveling motor 36L is set to a low speed (first speed), and when the swash plate switching cylinder 37L is extended, the speed of the first traveling motor 36L is set to a high speed (second speed). In other words, the speed of the first traveling motor 36L can be changed between a first speed, which is on the lower side, and a second speed, which is on the higher side.

The second traveling motor 36R is a motor that transmits power to the drive shaft of the driving device 5, which is located on the right side of the machine body 2. The second traveling motor 36R can be rotated by hydraulic fluid output from the second traveling pump 53R, and the revolutions speed (speed) can be changed according to the flow rate of the hydraulic fluid.

A swash plate switching cylinder 37R is connected to the second traveling motor 36R, and the revolutions speed (number of revolutions) of the second traveling motor 36R can also be changed by extending and shortening the swash plate switching cylinder 37R to one side or the other. That is, when the swash plate switching cylinder 37R is shortened, the speed of the second traveling motor 36R is set to a low speed (first speed) and When the swash plate switching cylinder 37R is extended, the number of revolutions of the second traveling motor 36R is set to a high speed (second speed). In other words, the speed of the second traveling motor 36R can be changed between the first speed, which is on the lower side, and the second speed, which is on the higher side.

As shown in FIG. 1, the hydraulic system for the working machine is provided with a traveling switch valve 34. The traveling switch valve 34 is switchable between a first state of setting the revolutions speed (speed) of the traveling motor (first traveling motor 36L, second traveling motor 36R) to a first speed and a second state of setting the speed to a second speed. The traveling switch valve 34 has first switch valves 71L and 71R, and a second switching valve 72.

The first switching valve 71L is a two-position switching valve connected via a fluid circuit to the swash plate switching cylinder 37L of the first traveling motor 36L, which switches to the first position 71L1 and the second position 71L2. The first switching valve 71L contracts the swash plate switching cylinder 37L in the first position 71L1, and extends the swash plate switching cylinder 37L in the second position 71L2.

The first switching valve 71R is a two-position switching valve connected via a fluid circuit to the swash plate switching cylinder 37R of the second traveling motor 36R, which switches to the first position 71R1 and the second position 71R2. The first switching valve 71R contracts the swash plate switching cylinder 37R in the first position 71R1, and extends the swash plate switching cylinder 37R in the second position 71R2.

The second switching valve 72 is a solenoid valve that switches the first switching valve 71L and the first switching valve 71R, and is a two-position switching valve that can be switched between the first position 72A and the second position 72B by magnetization. The second switching valve 72, the first switching valve 71L and the first switching valve 71R are connected by a fluid line 41.

The second switching valve 72 switches the first switching valve 71L and the first switching valve 71R to the first positions 71L1 and 71R1 when the first position 72*a*, and switches the first switching valve 71L and the first switching valve 71R to the second positions 71L2 and 71R2 when the second position 72*b*.

That is, when the second switching valve 72 is in the first position 72*a*, the first switching valve 71L is in the first position 71L1, and the first switching valve 71R is in the first position 71R1, the traveling switching valve 34 is in the first state, and the revolutions speed of the traveling motor (the first traveling motor 36L and the second traveling motor 36R) is set to the first speed.

When the second switching valve 72 is in the second position 72*b*, the first switching valve 71L is in the second position 71L2, and the first switching valve 71R is in the second position 71R2, the travel switching valve 34 is in the second state, and the revolutions speed of the travel motor (the first travel motor 36L and the second travel motor 36R) is set to the second speed.

Therefore, the traveling motor (first traveling motor 36L and second traveling motor 36R) can be switched by the traveling switching valve 34 to a first speed, which is on the lower side, and a second speed, which is on the higher side.

The switching between the first speed and the second speed in the traveling motor can be performed by a switching portion. The switching portion is, for example, a switch 61 connected to the controller device 60, which can be operated by a worker or other person.

The switching portion (switch 61) can be switched to either an increase in speed, which switches from a first speed (first state) to a second speed (second state), or a decrease in speed, which switches from a second speed (second state) to a first speed (first state).

The controller device 60 includes a CPU, a semiconductor such as an MPU, an electrical and electronic circuit, and the like. The controller device 60 switches the traveling switching valve 34 based on the switching operation of the switch 61. The switch 61 is a push switch.

The switch 61, for example, when the travel motor is pressed at the first speed, a command to set the travel motor to the second speed (an instruction to set the traveling switching valve 34 to the second state) is output to the controller device 60.

When the switch 61 is pressed by the traveling motor at the second speed, a command to set the traveling motor to the first speed (an instruction to set the traveling switching valve 34 to the first state) is output to the controller device 60.

The switch 61 may be a push switch that can be held on or off, and when it is off, a command to hold the traveling motor at the first speed is output to the controller device 60, and when it is on, a command to hold the traveling motor at the second speed is output to the controller device 60.

When the controller device 60 obtains a command to set the traveling switching valve 34 to the first state, the controller device 60 sets the traveling switching valve 34 to the first state by demagnetizing the solenoid of the second switching valve 72. When the controller device 60 obtains a command to set the traveling switching valve 34 to the second state, the controller device 60 sets the traveling switching valve 34 to the second state by exciting the solenoid of the second switching valve 72.

Now, the hydraulic system for the working machine is provided with a first hydraulic pump P1, a second hydraulic pump P2, and an operation device 54. The first hydraulic pump P1 is a pump driven by the power of the prime mover 32 and is composed of a gear pump of a constant displacement type.

The first hydraulic pump P1 is capable of outputting the hydraulic fluid stored in the tank 22. In particular, the first hydraulic pump P1 outputs hydraulic fluid that is mainly used for control. For convenience of explanation, the tank 22 storing the hydraulic fluid is sometimes referred to as the hydraulic fluid tank.

Of the hydraulic fluid output from the first hydraulic pump P1, the hydraulic fluid used for control may be referred to as pilot fluid and the pilot fluid pressure may be referred to as pilot pressure.

The second hydraulic pump P2 is a pump driven by the power of the prime mover 32 and is composed of a gear pump of a constant displacement type (a fixed displacement type). The second hydraulic pump P2 is capable of outputting hydraulic fluid stored in the tank 22 and supplies hydraulic fluid, for example, to the fluid line of the working system.

For example, the second hydraulic pump P2 supplies hydraulic fluid to the control valve (flow control valve) that controls the boom cylinder 14 that operates the boom 10, the bucket cylinder 15 that operates the bucket, and the auxiliary hydraulic actuator that operates the auxiliary hydraulic actuator.

The operation device 54 is a device for operating the traveling pumps (first traveling pump 53L and second traveling pump 53R) and is capable of changing the angle of the swash plate (swash plate angle) of the traveling pump. The operation device 54 includes an operation lever 59 and a plurality of operation valves 55.

The operation lever 59 is an operation lever supported by the control valve 55 and pivoted in the left and right (in the machine width direction) or front and rear directions. That is, the operation lever 59 is operable from the neutral position N to the right and to the left, and from the neutral position N to the front and backward, with reference to the neutral position N. In other words, the operation lever 59 is capable of pivoting in at least four directions with respect to the neutral position N.

For convenience of explanation, the forward and backward bi-directional direction, that is, the front and the rear, is referred to as the first direction. For the sake of explanation, the right and left directions, that is, the left and right (the machine width direction) are may be referred to as the second direction.

The plurality of operation valves 55 are operated by a common, that is, one operation lever 59. The plurality of operation valves 55 are actuated based on the rocking of the operation lever 59. A discharge fluid line 40 is connected to the plurality of operation valves 55, and hydraulic fluid (pilot fluid) from the first hydraulic pump P1 can be supplied through the discharge fluid line 40. The plurality of operation valves 55 are an operation valve 55A, an operation valve 55B, an operation valve 55C and an operation valve 55D.

The operation valve 55A changes the pressure of the hydraulic fluid output according to the operation amount (operation) of the front when the operation lever 59 is pivoted forward (one side) of the front and rear (first direction).

The operation valve 55B changes the pressure of the hydraulic fluid output according to the amount of operation (operation) of the backward operation when the operation lever 59 is pivoted backward (other direction) in the front and rear direction (first direction). Of the left and right directions (second direction), the pressure of the hydraulic fluid to be output by the operation valve 55C changes according to the amount of operation (operation) of the right operation when the operation lever 59 is pivoted to the right (one side) (when operated to the right).

The operation valve 55D changes the pressure of the hydraulic fluid output according to the amount of left-hand operation (operation) when the operation lever 59 is pivoted in the left (other) direction (left-hand operation) of the left-hand direction (second direction).

The plurality of operation valves 55 and the traveling pumps (first traveling pump 53L, second traveling pump 53R) are connected by a traveling fluid line 45. In other words, the traveling pumps (first traveling pump 53L, second traveling pump 53R) are hydraulic devices that can be operated by hydraulic fluid output from the operation valve 55 (operation valve 55A, operation valve 55B, operation valve 55C, operation valve 55D).

The traveling fluid line 45 has a first traveling fluid line 45*a*, a second traveling fluid line 45*b*, a third traveling fluid line 45*c*, a fourth traveling fluid line 45*d*, and a fifth traveling fluid line 45*e*.

A first traveling fluid line 45*a* is a fluid line connected to the pressure receiver portion 53*a* of the traveling pump 53L for forward motion. A second travel fluid line 45*b* is connected to the backward pressure receiver portion 53*b* of the traveling pump 53L. A third traveling fluid line 45*c* is a fluid line connected to the forward receiver portion 53*a* of the traveling pump 53R.

The fourth traveling fluid line 45*d* is a fluid line connected to the rearward receiver portion 53*b* of the traveling pump 53R. The fifth traveling fluid line 45*e* is a fluid line connecting the operation valve 55, the first traveling fluid line 45*a*, the second traveling fluid line 45*b*, the third traveling fluid line 45*c*, and the fourth traveling fluid line 45*d*.

When the operation lever 59 is pivoted forward (in the direction of an arrowed line A1 shown in FIG. 1), the operation valve 55A is operated, and pilot pressure is output from the operation valve 55A. This pilot pressure acts on the pressure receiver portion 53*a* of the first traveling pump 53L via the first traveling fluid line 45*a* and on the pressure receiver portion 53*a* of the second traveling pump 53R via the third traveling fluid line 45*c*.

This changes the swash plate angle of the first traveling pump 53L and the second traveling pump 53R, causing the first traveling motor 36L and the second traveling motor 36R to rotate forward (forward rotation) and the working machine 1 to travel straight ahead.

When the operation lever 59 is pivoted backward (in the direction of an arrowed line A2 in FIG. 1), the operation valve 55B is operated, and pilot pressure is output from the operation valve 55B. This pilot pressure acts on the pressure receiver portion 53*b* of the first traveling pump 53L via the second traveling fluid line 45*b* and on the pressure receiver portion 53*b* of the second traveling pump 53R via the fourth traveling fluid line 45*d*.

This changes the swash plate angle of the first traveling pump 53L and the second traveling pump 53R, causing the first traveling motor 36L and the second traveling motor 36R to reverse (backward rotation) and the working machine 1 to travel straight backward.

When the operation lever 59 is pivoted to the right (in the direction of an arrowed line A3 in FIG. 1), the operation valve 55C is operated and pilot pressure is output from the operation valve 55C. This pilot pressure acts on the pressure receiver portion 53*a* of the first traveling pump 53L via the first traveling fluid line 45*a* and on the pressure receiver portion 53*b* of the second traveling pump 53R via the fourth traveling fluid line 45*d*.

This changes the swash plate angle of the first traveling pump 53L and the second traveling pump 53R, causing the first traveling motor 36L to rotate forward and the second traveling motor 36R to reverse, causing the working machine 1 to turn to the right.

When the operation lever 59 is pivoted to the left (in the direction of an arrowed line A4 in FIG. 1), the operation valve 55D is operated, and pilot pressure is output from the operation valve 55D. This pilot pressure acts on the pressure receiver portion 53*a* of the second traveling pump 53R via the third traveling fluid line 45*c* and on the pressure receiver portion 53*b* of the first traveling pump 53L via the second traveling fluid line 45*b*.

This changes the swash plate angle of the first traveling pump 53L and the second traveling pump 53R, causing the first traveling motor 36L to reverse and the second traveling motor 36R to revolve forward, causing the working machine 1 to turn to the left.

When the operation lever 59 is rocked in an oblique direction, the differential pressure of the pilot pressure acting on the pressure receiver portions 53*a* and 53*b* determines the direction and speed of revolutions of the first traveling motor 36L and the second traveling motor 36R, causing the working machine 1 to turn right or left while moving forward or backward.

That is, when the operation lever 59 is pivoted forward diagonally to the left, the working machine 1 turns left while moving forward at a speed corresponding to the pivoting angle of the operation lever 59. When the operation lever 59 is pivoted diagonally forward to the right, the working machine 1 swings right while moving forward at a speed corresponding to the pivoting angle of the operation lever 59. When the operation lever 59 is pivoted backward left diagonally, the working machine 1 turns left while moving backward at a speed corresponding to the pivoting angle of the operation lever 59. When the operation lever 59 is pivoted backward at a right angle, the working machine 1 turns right while moving backward at a speed corresponding to the pivoting angle of the operation lever 59.

Now, the controller device 60 is connected to the accelerator 65, which sets the prime mover speed. The accelerator 65 is located near the operator seat 8. The accelerator 65 includes an accelerator lever pivotally supported, an accelerator pedal pivotally supported, an accelerator volume rotatably supported, an accelerator slider slidably supported, and the like. The accelerator 65 is not limited to the examples described above.

The controller device 60 is connected to a revolutions detector device 66 that detects the number of prime mover revolutions. The revolutions detector device 66 allows the controller device 60 to ascertain the actual number of prime mover revolutions (the actual number of revolutions) of the prime mover 32.

The controller device 60 sets a target prime mover speed (target speed) based on the amount of operation of the accelerator 65, and controls the actual speed so that the actual speed of the prime mover 32 becomes the set target speed. That is, the controller device 60 changes the actual speed of the prime mover 32 by, for example, outputting the instructed revolving speed to the prime mover 32 so that the actual speed of the prime mover 32 becomes the target speed.

Now, the controller device 60 reduces the prime mover speed when switching the traveling switching valve 34 from the first state (first speed) to the second state (second speed), that is, when the revolutions speed of the travel motor is increased from the first speed to the second speed.

Figure 2A:
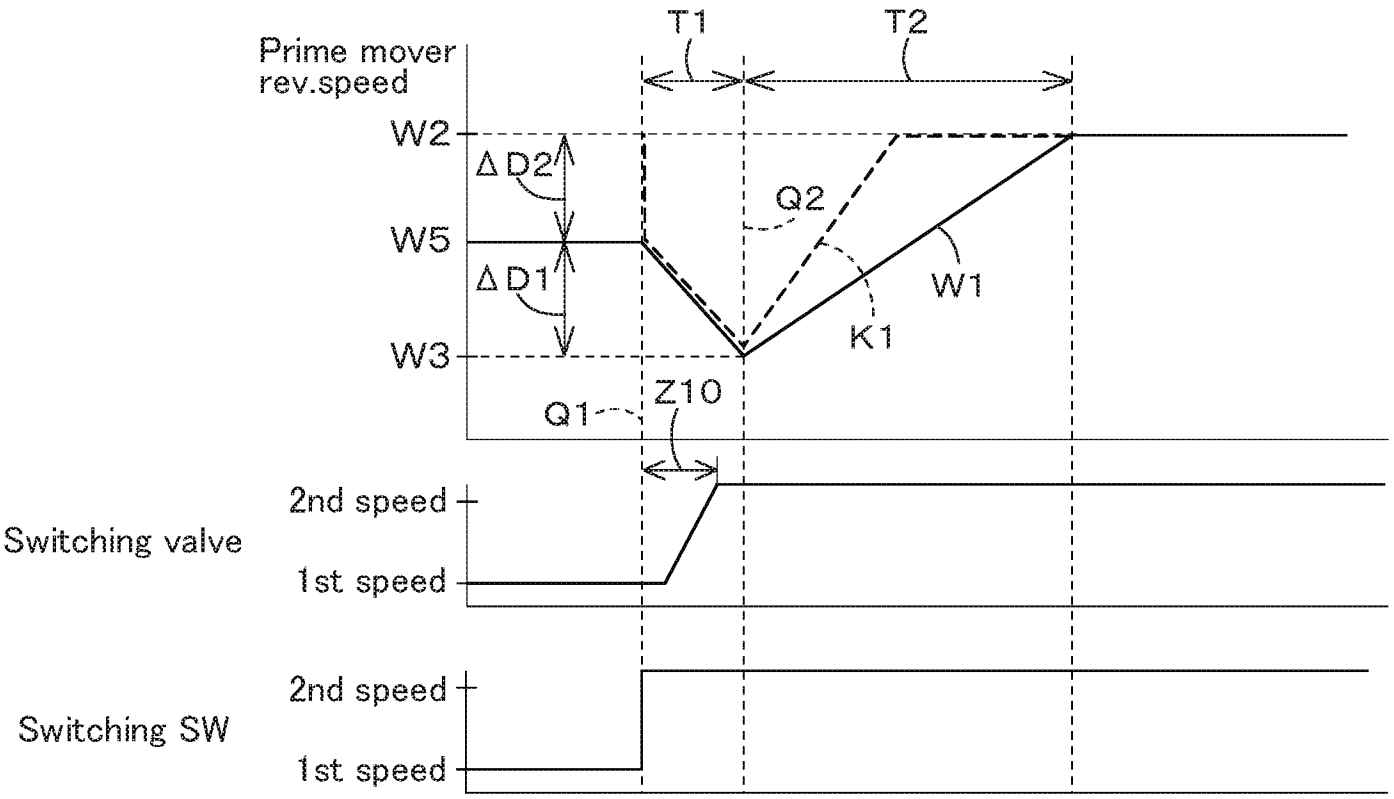
FIG. 2A is a view showing a relation between a revolving speed of a prime mover and switching of a traveling motor in a case where a traveling motor is accelerated.

FIG. 2A shows the relation between the speed of the prime mover (target speed and actual speed) and the switching of the traveling motor when the speed of the traveling motor is increased from the first speed to the second speed. A reference numeral Z10 in FIG. 2A is the changeover time from the time the speed increase command is given by the switch 61 to the time the traveling switching valve 34 is switched from the first state to the second state.

As shown in FIG. 2A, the controller device 60 at time Q1 obtains an increase in speed command (the second speed command) to change the speed from the first state (first speed) to the second state (second speed), as shown in FIG. 2A, when the switch (changeover SW) 61 is operated. When the controller device 60 acquires the second speed command, the controller device 60 calculates the dropping amount ΔD2 between the target speed (first target speed) W2 set by the accelerator 65 and the actual speed detected by the revolutions detector device 66.

When the dropping amount ΔD2 between the first target speed W2 and the actual speed W1 is greater than or equal to a threshold, the controller device 60 changes the instructed revolving speed K1, which is commanded to the prime mover 32, steeply to a third target speed W5, which is lower than the first target speed W2 and higher than the second target speed W3, and then changes the instructed revolving speed K1 to the second target speed W3. Thereby, the controller device 60 performs a lowering control that lowers the actual revolving speed to the second target revolving speed W3. For example, the controller device 60 sets the third target revolutions speed W5 to the same revolutions speed as the actual revolutions speed in the vicinity of the actual revolutions speed in the vicinity of Q1 when the switch (changeover SW) 61 is operated.

More specifically, the controller device 60 sets the third target speed W5 to either the actual number of revolutions at time Q1, the average of the actual number of revolutions W1 before a predetermined time (for example, within 1 second) before time Q1, or the actual number of revolutions within 0.1 seconds back from time Q1.

The second target speed W3 is the number of revolutions to reduce the shifting shock when switching from the first speed to the second speed, for example, the value of the dropping amount ΔD1 is subtracted from the actual number of revolutions W1. The controller device 60 changes steeply to the third target speed W5 when the dropping amount ΔD2 is greater than or equal to the threshold value, but may also change steeply to the third target speed W5 regardless of the value of the dropping amount ΔD2.

The controller device 60 returns the real revolutions speed W1 to the first target revolving speed W2 when the real revolutions speed W1 reaches the second target revolving speed W3 at time Q2. Here, the controller device 60 makes the return time T2, which returns the actual revolving speed W1 from the second target revolving speed W3 to the first target revolving speed W2, longer than the decreasing time T1. That is, the controller device 60 makes the decrease speed of lowering the actual revolving speed W1 to the second target revolving speed W3 faster than the return speed of returning the actual revolving speed W1 from the second target revolving speed W3 to the first target revolving speed W2.

In the case of returning the actual speed W1 from the second target speed W3 to the first target speed W2, the return time T2 can be shortened when there is no load on the prime mover 32. In other words, the controller device 60 can shorten the target return time T2 when the load on the prime mover 32 is reduced.

The controller device 60 also outputs a signal to magnetize the solenoid of the traveling switching valve 34, at least during the decreasing time T1, that is, before starting control to return the actual speed W1 from the second target speed W3 to the first target speed W2, to magnetize the solenoid of the traveling switching valve (switching valve) 34 from the first state (first speed) to the second state (second speed)). In other words, the controller device 60 returns the actual speed W1 to the first target speed W2 after switching the traveling switching valve 34 to the second state.

Figure 3A:
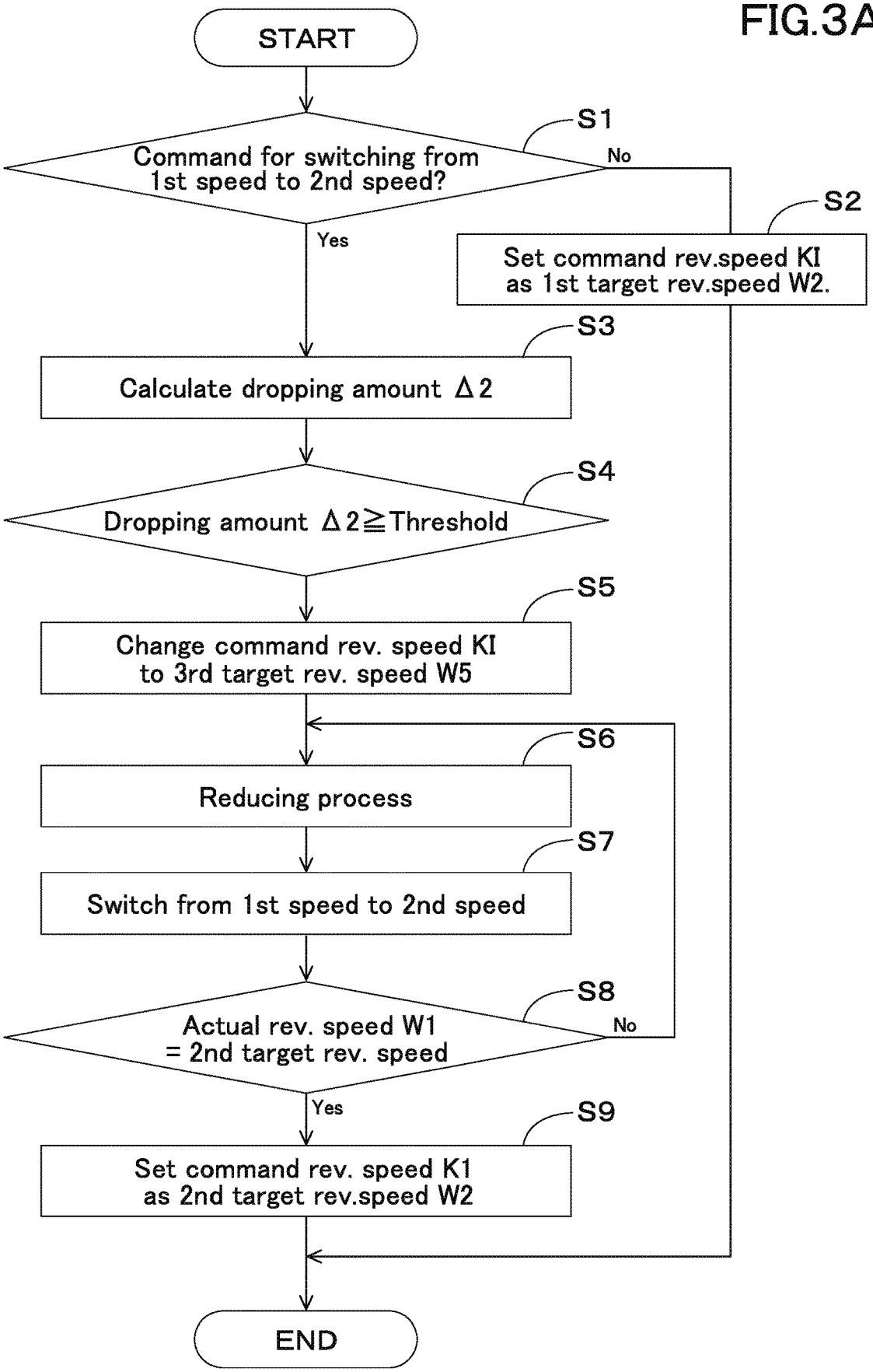
FIG. 3A is a view showing a first operation flow of a controller device in a case where a traveling motor is accelerated.

FIG. 3A illustrates the control flow of the controller device 60 when the revolutions speed of the traveling motor is changed from a first speed to a second speed. The working machine is in a traveling state where it is traveling rather than at a standstill.

The controller device 60 determines whether the switch 61 has been switched from the first speed to the second speed (step S1).

When the switch 61 is not switched to the second speed, that is, the switch is maintained at the first speed (step S1, No), the controller device 60 sets the instructed revolving speed K1 to the first target speed W2 (step S2).

When the switch 61 is switched from the first speed to the second speed (step S1, Yes), the controller device 60 calculates the dropping amount, ΔD2 (step S3).

When the dropping amount ΔD2 is greater than or equal to the threshold (step S4, Yes), the instructed revolving speed K1 is instantly changed to the third target speed W5 (step S5).

Thereafter, a decreasing process (decreasing control) is performed that gradually brings the instructed revolving speed K1 closer to the second target speed W3 (step S6).

Before the actual speed W1 reaches the second target speed W3, the controller device 60 switches the traveling switching valve 34 from a first state (first speed) to a second state (second speed) (step S7).

The controller device 60 determines whether the actual speed W1 reaches the second target speed W3 (step S8), and when the actual speed W1 reaches the second target speed W3 (step S8, Yes), the instructed revolving speed K1 is set to the first target speed W2 (step S9).

When the actual speed W1 has not reached the second target speed W3 (step S8, No), the controller device 60 returns to the lowering process (lowering control) at step S5 and lowers the actual speed.

When the traveling switching valve 34 has already been switched from the first state (first speed) to the second state (second speed) (when the process at step S7 has already been performed), the process at step S7 is skipped and the process at step S8 is transferred to the process at step S8.

The process of decreasing the actual speed W1 toward the second target speed W3 and the process of switching the traveling switching valve 34 may be processed separately and in parallel in the controller device 60.

Now, in the embodiment described above, the prime mover speed is reduced when the working machine 1 is increased from the first speed to the second speed, but the prime mover speed may be reduced when the working machine 1 is decelerated from the second speed to the first speed.

The controller device 60 reduces the prime mover speed when switching the traveling switching valve 34 from the second state (second speed) to the first state (first speed), that is, when switching the revolutions speed of the travel motor from the second speed to the first speed.

Figure 2B:
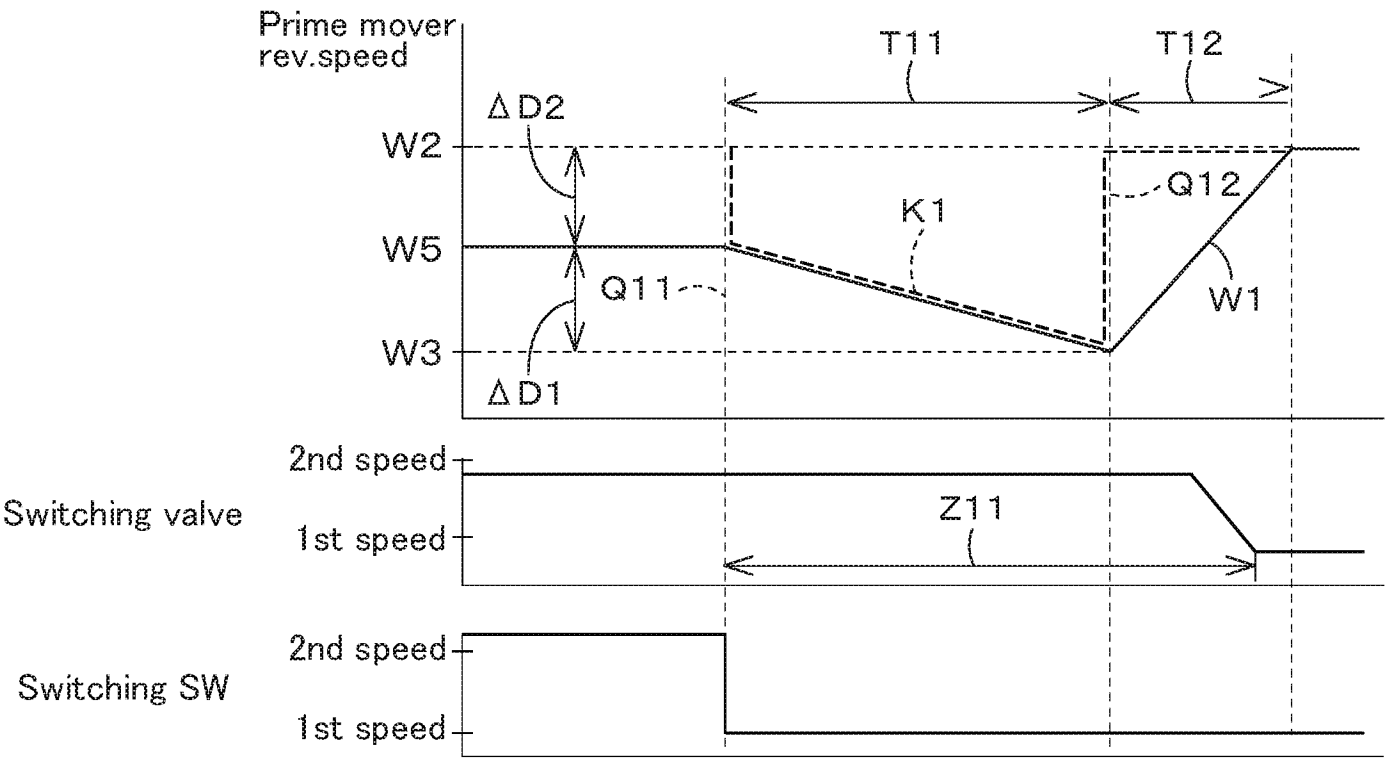
FIG. 2B is a view showing a relation between a revolving speed of a prime mover and switching of a traveling motor in a case where a traveling motor is decelerated.

FIG. 2B is a diagram showing the relation between the speed of the prime mover (target speed and actual speed) and the switching of the traveling motor when the traveling motor is decelerated from the first to the second speed. A reference numeral Z11 in FIG. 2B is the switching time from the time the deceleration is commanded by the switch 61 to the time the traveling switch valve 34 is switched from the second state to the first state.

As shown in FIG. 2B, the controller device 60 assumes that at time Q11, the switch (changeover SW) 61 is operated and the controller device 60 obtains a deceleration command (the first speed command) to reduce the speed from the second state (second speed) to the first state (first speed). When the controller device 60 acquires the first speed command, the controller device 60 calculates a dropping amount, ΔD2, between the first target speed W2 and the actual speed.

When the dropping amount ΔD2 between the first target speed W2 and the actual speed W1 is greater than or equal to a threshold value, the controller device 60 performs a lowering control to reduce the actual speed to the second target speed W3 by changing the instructed revolving speed K1 to the third target speed W5, which is lower than the first target speed W2 and higher than the second target speed W3, after changing the instructed revolving speed K1 to the third target speed W5, which is lower than the first target speed W2, and then making the instructed revolving speed K1 to the second target speed W3.

The controller device 60 returns the actual revolving speed W1 to the first target revolving speed W2 when the actual revolving speed W1 reaches the second target revolving speed W3 at time Q12. The controller device 60 makes the return time T12, which returns the actual revolving speed W1 from the second target revolving speed W3 to the first target revolving speed W2, shorter than the decreasing time T11. That is, the controller device 60 makes the decrease speed of lowering the actual revolving speed W1 to the second target revolving speed W3 slower than the return speed of returning the actual revolving speed W1 from the second target revolving speed W3 to the first target revolving speed W2.

In the case of returning the actual speed W1 from the second target speed W3 to the first target speed W2, the return time T12 can be shortened when there is no load on the prime mover 32. In other words, the controller device 60 can shorten the target return time T12 when the load on the prime mover 32 is reduced.

The controller device 60 outputs a signal to demagnetize the solenoid of the traveling switching valve 34 to switch the traveling switching valve (switching valve) 34 from the second state (second speed) to the first state (first speed) by outputting a signal to demagnetize the solenoid of the traveling switching valve 34 at least after the actual speed W1 reaches the second target speed W3 and before the first target speed W2 is reached. In other words, the controller device 60 returns the actual speed W1 to the first target speed W2 after switching the traveling switching valve 34 to the first state.

Figure 3B:
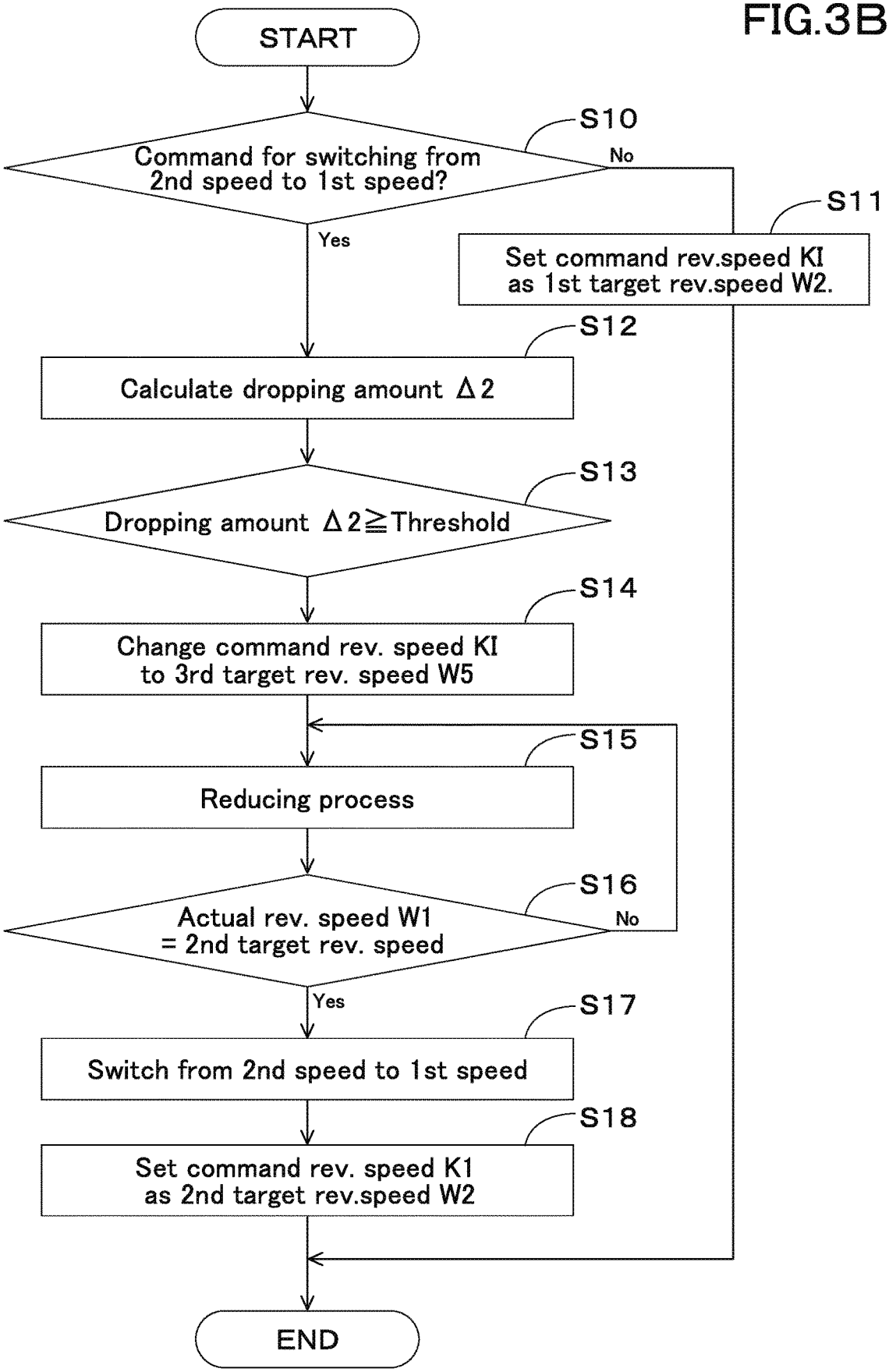
FIG. 3B is a view showing a second operation flow of a controller device in a case where a traveling motor is decelerated.

FIG. 3B illustrates the control flow of the controller device 60 when the revolutions speed of the traveling motor is changed from a second speed to a first speed. The working machine is in a traveling state where it is traveling rather than at a standstill.

The controller device 60 determines whether the switch 61 has been switched from the second speed to the first speed (step S10).

When the switch 61 is not switched to the first speed, that is, the switch is maintained at the second speed (step S10, No), the controller device 60 sets the instructed revolving speed K1 to the first target speed W2 (step S11).

When the switch 61 is switched from the second speed to the first speed (step S10, Yes), the controller device 60 calculates the dropping amount ΔD2 (step S12).

If the dropping amount ΔD2 is greater than or equal to the threshold (step S13, Yes), the instructed revolving speed K1 is instantly changed to the third target speed W5 (step S14).

Thereafter, a decreasing process (decreasing control) is performed that gradually brings the instructed revolving speed K1 closer to the second target speed W3 (step S15).

The controller device 60 determines whether the actual speed W1 reaches the second target speed W3 (step S16), and when the actual speed W1 reaches the second target speed W3 (step S16, Yes), the controller device 60 switches the traveling switching valve 34 from the second state (second speed) to the first state (first speed) (step S17).

That is, after the actual speed W1 reaches the second target speed W3, the controller device 60 switches the traveling switching valve 34 from the second state (second speed) to the first state (first speed).

The controller device 60 also sets the instructed revolving speed K1 to the first target speed W2 (step S18).

When the actual speed W1 has not reached the second target speed W3 (step S16, No), the controller device 60 returns to the lowering process (lowering control) at step S5 and lowers the actual speed.

In the controller device 60, the process of decreasing the actual speed W1 toward the second target speed W3 and the process of switching the traveling switching valve 34 may be processed separately and in parallel.

The working machine 1 includes the prime mover 32, the traveling pump (the first traveling pump 53L, the second traveling pump 53R) to be activated by the prime mover 32 and to output operation fluid, the traveling motor (the first traveling motor 36L, the second traveling motor 36R) to be driven by the operation fluid outputted by the traveling pump (the first traveling pump 53L, the second traveling pump 53R) and to switch a revolving speed between a first speed and a second speed higher than the first speed, the machine body 2 on which the prime mover 32, the traveling pump (the first traveling pump 53L, the second traveling pump 53R), and the traveling motor (the first traveling motor 36L, the second traveling motor 36R) are provided, the switching valve 34 to switch between a first state and a second state, the first state allowing the revolving speed of the traveling motor (the first traveling motor 36L, the second traveling motor 36R) to be the first speed, the second state allowing the revolving speed of the traveling motor (the first traveling motor 36L, the second traveling motor 36R) to be the second speed, the accelerator 65 to set a first target revolving speed W2 of the prime mover 32, the revolving detector 66 to detect an actual revolving speed of the prime mover 32; and the controller device 60 to reduce the revolving speed of the prime mover 32 in either acceleration to switch from the first state to the second state or deceleration to switch from the second state to the first state. The controller device 60 reduces the actual revolving speed W1 to the second target revolving speed W3 after the instructed rotating speed is set to a third target revolving speed W5 that is lower than the first target revolving speed W2 and higher than the second target revolving speed W3 in a switch timing in either the acceleration or the deceleration.

According to this, when the actual speed W1 of the prime mover 32 drops lower than the first target speed W2 set by the accelerator 65, the instructed revolving speed is lowered from the first target speed W2 to the third target speed W5, and then the actual speed W1 is lowered to the second target speed W3, so that the shifting shock can be reduced even when the speed of the prime mover 32 has dropped due to load or other factors.

The controller device 60 sets the third target speed W5 in the vicinity of the actual speed when the switching operation is performed. According to this, the third target speed W5 can almost match the third target speed W5 to the actual speed W1 of the prime mover 32 in the drop state before the drop control is performed to reduce the actual speed W1 of the prime mover 32 to the second target speed W3, thus reducing the shifting shock at the time of shifting gears (at acceleration and at deceleration) more.

The controller device 60 sets the instructed revolving speed to the first target speed W2 when either the acceleration or the speed reduction is not performed. According to this, while the actual speed of the prime mover 32 is reduced by reducing the actual speed of the prime mover 32 by changing the target speed for the increase or reduction of speed, when either the increase or reduction of speed is not performed, the work can be smoothly performed by the first target speed W2 set by the operator at the accelerator 65 arbitrarily.

The working machine 1 is provided with the first traveling device 5L on the left side of the machine body 2 and the second traveling device 5R on the right side of the machine body 2. The traveling motors include the first traveling motor 36, which transmits the power for traveling to the first traveling device 5L, and the second traveling motor 36R, which transmits the power for traveling to the second traveling device 5R. The traveling pump is capable of operating the first traveling motor 36L and the second traveling motor 36R. The traveling switching valve is capable of switching the first traveling motor 36L and the second traveling motor 36R to a first speed and a second speed. According to this, the first traveling motor 5L and the second traveling motor 5R can easily reduce the gearshift shock at the time of shifting gears when traveling by the first traveling motor 5L and the second traveling motor 5R, thus improving the workability of the system.

The controller device 60 may change the dropping amount ΔD1 based on the actual number of revolutions W1 when decelerating from the second speed to the first speed. The controller device 60 changes the dropping amount ΔD1 to be the actual speed W1 at time Q1.

Alternatively, the controller device 60 modifies the amount of decrease ΔD1 so that the actual number of revolutions W1 a little before the time point Q1. Alternatively, the controller device 60 changes the amount of the decrease ΔD1 so that it is an average of the actual number of revolutions W1 prior to the predetermined time point Q1.

The controller device 60, for example, in the case of decelerating, the higher the real speed W1 is, the greater the dropping amount ΔD1 is, and the lower the real speed W1 is, the smaller the dropping amount ΔD1 is. In the case of decelerating, the controller device 60 slows down the speed reduction rate until the real speed W1 reaches the second target speed W3, which is slower than the acceleration rate until the real speed W1 reaches the first target speed W2 from the second target speed W3.

The controller device 60 may correspond (correlate) with the timing of reducing the actual speed W1 toward the second target speed W3 and then starting the return to the first target speed W2 and the timing of switching the traveling switching valve 34 when either deceleration or acceleration is performed.

Figure 4:
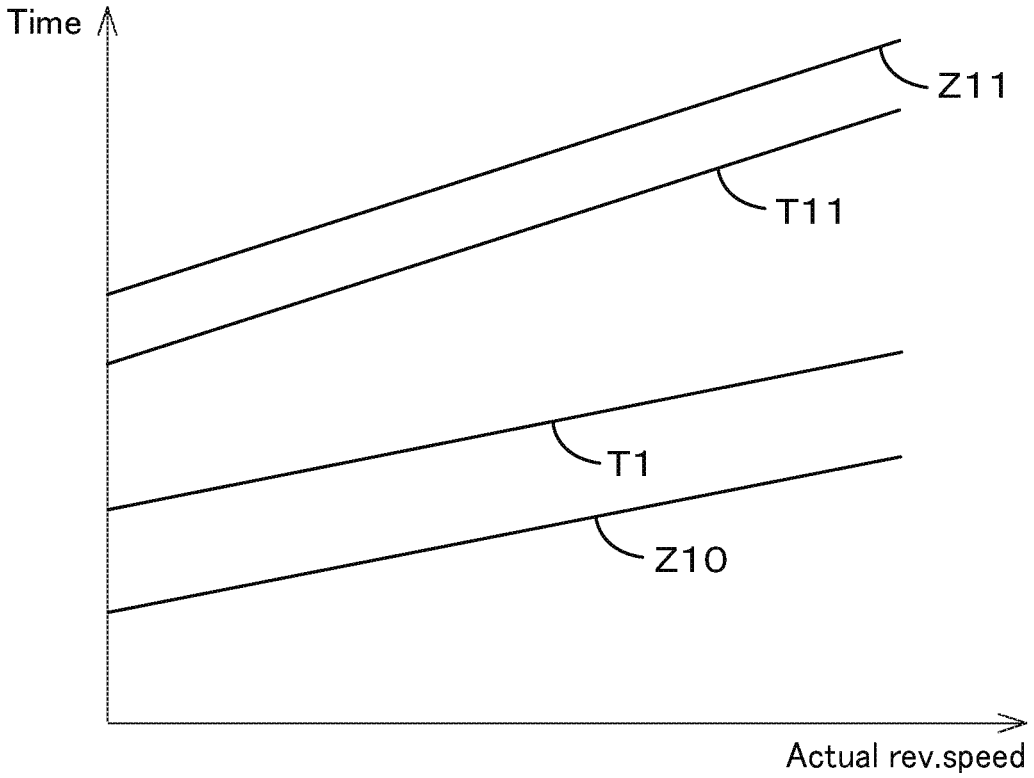
FIG. 4 is a view showing a relation between an actual revolving speed W1, reduction times T1 and T11, and switching times Z10 and Z11.

FIG. 4 shows the relation between the actual speed W1 and the actual speed W1, the decreasing time T1 and T11, and the switching time Z10 and Z11 during the operation of the deceleration and increase in speed. In FIG. 4, the minimum value of the actual speed on the horizontal axis is greater than the idle speed.

As shown in FIG. 4, the lines indicating the decrease times T1 and T11, and the switching times Z10 and Z11, respectively, are straight lines that gradually increase as the actual number of revolutions W1 increases and are proportional to the actual number of revolutions W1.

The slope of the decreasing time T1 and the line indicating the decreasing time T1 and the switching time Z10 is slightly smaller than the line indicating the decreasing time T11 and the switching time Z11. That is, the lines indicating the decreasing time T11 and the switching time Z11 are slower than the lines indicating the decreasing time T1 and the switching time Z10, and the slope of the increase or decrease is larger.

As the decreasing time T11 increases, the switching time Z11 also increases proportionally, and as the decreasing time T11 decreases, the switching time Z11 also decreases proportionally. As the decreasing time T1 increases, the switching time Z10 also increases proportionally, and as the decreasing time T1 decreases, the switching time Z10 also decreases proportionally.

As shown in FIG. 4, for example, the controller device 60, in performing deceleration and acceleration, gradually increases the decreasing time T1 and T11 from decreasing the actual speed W1 at the time of operation to starting the recovery, as the actual speed W1 increases, and gradually increases the switching time Z10 and Z11 from the operation of either acceleration or deceleration to switching the traveling switching valve 34.

In other words, the controller device 60 shortens the decreasing time T1 and T11 as the actual speed W1 is lowered, and shortens the switching time Z10 and Z11 from the time either the deceleration or the increase in speed is operated until the switching of the traveling switching valve 34.

The controller device 60 does not perform the lowering control (lowering treatment) when the actual speed W1 is less than or equal to the idling speed when decelerating and increasing the speed, and immediately switches the traveling switching valve 37 (the switching time Z10 and Z11 is zero). The controller device 60 performs the lowering control when the working machine 1 is traveling, when the deceleration is operated, and does not perform the lowering control when the working machine 1 is stopped from traveling.

The working machine 1 includes the prime mover 32, the traveling pump (the first traveling pump 53L, the second traveling pump 53R) to be activated by the prime mover 32 and to output operation fluid, the traveling motor (the first traveling pump 53L, the second traveling pump 53R) to be driven by the operation fluid outputted by the traveling pump (the first traveling pump 53L, the second traveling pump 53R) and to switch a revolving speed between a first speed and a second speed higher than the first speed, the machine body 2 on which the prime mover 32, the traveling pump (the first traveling pump 53L, the second traveling pump 53R), and the traveling motor are provided, the traveling switching valve 34 to switch between a first state and a second state, the first state allowing the revolving speed of the traveling motor to be the first speed, the second state allowing the revolving speed of the traveling motor to be the second speed, the accelerator 65 to set the first target revolving speed W2 of the prime mover 32, the revolving detector 66 to detect the actual revolving speed W1 of the prime mover 32, and the controller device 60 to reduce the revolving speed of the prime mover 32 in either acceleration to switch from the first state to the second state or deceleration to switch from the second state to the first state, The controller device 60 associates a return timing with a switch timing in either the acceleration or the deceleration, the return timing allowing the actual revolving speed W1 to start returning toward the first target revolving speed W2 after the actual revolving speed W1 is reduced, the switch timing to allow the switching valve 37 to switch to either an acceleration side or a deceleration side.

According to this, by mapping the return timing to the changeover timing, the shifting shock can be reduced no matter what the actual speed W1 is.

As the actual speed W1 increases, the controller device 60 gradually increases the decreasing time T1 and T11 from decreasing the actual speed W1 to starting the recovery, and gradually increases the switching time Z10 and Z11 from the operation of either the increase or decrease in speed to switching the traveling switching valve 37.

According to this, as the actual speed W1 increases, the decreasing time T1 and T11 is gradually lengthened, and the switching time Z10 and Z11 until the traveling switching valve 37 is switched, the switching time Z10 and Z11 is lengthened, so that the traveling switching valve 34 can be switched in a stable manner and shifting shock can be reduced.

As the actual speed W1 is lowered, the controller device 60 gradually shortens the decreasing time T1 and T11 from the time the actual speed W1 is reduced to the time when the actual speed W1 is reduced to the time when the recovery is started, and gradually shortens the switching time Z10 and Z11 from the operation of either the increase or decrease in speed to the time when the traveling switching valve 37 is switched off.

According to this, as the actual speed W1 becomes lower, the decreasing time T1 and T11 is gradually shortened, and the switching time Z10 and Z11 until the traveling switching valve 37 is switched, the switching time Z10 and Z11 is shortened, so that the traveling switching valve 34 can be switched stably, and the shifting shock can be reduced.

The controller device 60 does not reduce the speed of the prime mover 32 when either the acceleration or the speed reduction operation is performed and the actual speed W1 is less than or equal to the idling speed. According to this, below the idling speed, the speed of the prime mover 32 can be shifted while maintaining the revolutions speed of the prime mover 32.

The controller device 60 reduces the speed of the prime mover 32 when a deceleration operation is performed when the machine 2 is traveling. In addition, the controller device 60 does not reduce the speed of the prime mover 32 when the operation of deceleration is performed when the machine 2 is stopped.

According to this, while continuing to run and work while reducing the shifting shock when the machine body 2 is traveling, workability can be maintained because the speed of the prime mover 32 does not decrease when the machine body 2 is at a standstill.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

In the above-described embodiment, the switching portion is configured with the switch 61 that can be operated manually or otherwise by an operator or the like, but it may be built into the controller device 60. When built into the controller device 60, the switching portion includes a program, electricity, and electronic components (electronic circuits) stored in the controller device 60.

In this case, the switching portion of the controller device 60 determines whether to switch between the first or second speed state based on detection information from various detection devices, for example, sensors, provided in the working machine 1, and outputs a control signal to the traveling switching valve 34 based on the result of the determination.

The traveling switching valve 34 switches to the first gear state when a control signal for the first gear state is obtained, and to the second gear state when a control signal for the second gear state is obtained.

The traveling switching valve 34 may be a valve that is capable of switching the traveling motor (first traveling motor 36L, second traveling motor 36R) to the first state to bring the traveling motor (first traveling motor 36L, second traveling motor 36R) to the first speed and the second state to bring the traveling motor to the second speed, which may be a proportional valve different from the directional switching valve.

The traveling motor may be a motor having a neutral (neutral) between the first speed and the second speed.

The traveling motor (the first traveling motor 36L and the second traveling motor 36R) may be an axial piston motor or a radial piston motor. When the traveling motor is an axial piston motor and a radial piston motor, the motor displacement can be switched to the first speed by increasing the motor displacement, and the motor displacement can be switched to the second speed by decreasing the motor displacement.

What is claimed is:

1. A working machine comprising:

a prime mover;

a traveling pump to be activated by the prime mover and to output operation fluid;

a traveling motor to be driven by the operation fluid outputted by the traveling pump and to rotate at a speed shiftable between a first speed and a second speed higher than the first speed;

a machine body on which the prime mover, the traveling pump, and the traveling motor are provided;

a switching valve shiftable between a first speed position to cause the traveling motor to rotate at the first speed and a second speed position to cause the traveling motor to rotate at the second speed, the shift of the switching valve from the first speed position to the second speed position being referred to as shift-up, and the shift of the switching valve from the second speed position to the first speed position being referred to as shift-down;

a speed shifter configured to output a signal for either the shift-up or the shift-down;

an accelerator to be operated to set a first target revolving speed of the prime mover;

a revolving speed detector to detect an actual revolving speed of the prime mover; and a controller configured or programmed to control the actual revolving speed of the prime mover in response to the operation of the accelerator, wherein when the speed shifter outputs the signal for either the shift-up or the shift-down, the controller commands the prime mover to revolve at a third target revolving speed that is lower than the first target revolving speed and higher than a second target revolving speed immediately after the speed shifter outputs the signal for the shift-up or the shift-down, and then commands the prime mover to revolve at the second target revolving speed so as to reduce the actual revolving speed to the second target revolving speed, and in correspondence with the shift of the switching valve and after receiving the signal output from the speed shifter for either the shift-up or the shift-down, the controller commands the prime mover to revolve at the second target revolving speed that is lower than the first target revolving speed so as to reduce the actual revolving speed to the second target revolving speed, and then commands the prime mover to revolve at the first target revolving speed so as to return the actual revolving speed to the first target revolving speed.

2. The working machine according to claim 1, wherein the controller sets the third target revolving speed to be substantially the actual revolving speed at the time when the speed shifter outputs the signal for either the shift-up or the shift-down.

3. The working machine according to claim 2, wherein the controller commands the prime mover to revolve at the first target revolving speed while the speed shifter does not output the signal for either the shift-up or the shift-down.

4. The working machine according to claim 3, comprising:

a first traveling device located on a left side of the machine body; and a second traveling device located on a right side of the machine body, wherein the traveling motor includes:

a first traveling motor to provide a traveling power to the first traveling device; and a second traveling motor to provide a traveling power to the second traveling device, the traveling pump is configured to activate the first traveling motor and the second traveling motor, and the switching valve is configured to shift the speeds of rotations of both the first traveling motor and the second traveling motor between the first speed and the second speed.

5. The working machine according to claim 2, comprising:

a first traveling device located on a left side of the machine body; and a second traveling device located on a right side of the machine body, wherein the traveling motor includes:

a first traveling motor to provide a traveling power to the first traveling device; and a second traveling motor to provide a traveling power to the second traveling device, the traveling pump is configured to activate the first traveling motor and the second traveling motor, and the switching valve is configured to shift the speeds of rotations of both the first traveling motor and the second traveling motor between the first speed and the second speed.

6. The working machine according to claim 1, wherein the controller commands the prime mover to revolve at the first target revolving speed while the speed shifter does not output the signal for either the shift-up or the shift-down.

7. The working machine according to claim 6, comprising:

a first traveling device located on a left side of the machine body; and a second traveling device located on a right side of the machine body, wherein the traveling motor includes:

a first traveling motor to provide a traveling power to the first traveling device; and a second traveling motor to provide a traveling power to the second traveling device, the traveling pump is configured to activate the first traveling motor and the second traveling motor, and the switching valve is configured to shift the speeds of rotations of both the first traveling motor and the second traveling motor between the first speed and the second speed.

8. The working machine according to claim 1, comprising:

a first traveling device located on a left side of the machine body; and a second traveling device located on a right side of the machine body, wherein the traveling motor includes:

a first traveling motor to provide a traveling power to the first traveling device; and a second traveling motor to provide a traveling power to the second traveling device, the traveling pump is configured to activate the first traveling motor and the second traveling motor, and the switching valve is configured to shift the speeds of rotations of both the first traveling motor and the second traveling motor between the first speed and the second speed.

9. The working machine according to claim 1, wherein a difference between the first target revolving speed and the actual revolving speed, when the actual revolving speed is lower than the first target revolving speed, is referred to as a dropping amount, the actual revolving speed being detected by the revolving speed detector at the time when the speed shifter outputs the signal for the shift-up or the shift-down, and the controller commands the prime mover to revolve at the third target revolving speed only when the dropping amount of the actual revolving speed is a threshold or more.

10. The working machine according to claim 1, wherein the controller is configured or programmed to control a shift-action of the switching valve between the first speed position and the second speed position, and when the speed shifter outputs the signal for the shift-up, the controller starts the shift-action of the switching valve from the first speed position to the second speed position after the actual revolving speed of the prime mover starts reducing toward the second target revolving speed, and ends the shift-action of the switching valve to the second speed position before the actual revolving speed of the prime mover having been reduced to the second target revolving speed starts returning toward the first target revolving speed.

11. The working machine according to claim 10, wherein when the speed shifter outputs the signal for the shift-up, the controller controls the revolving speed of the prime mover and the shift-action of the switching valve so that as the actual revolving speed of the prime mover detected by the revolving speed detection device at the time when the speed shifter outputs the signal for the shift-up becomes larger, a revolving speed reduction time from start of reducing the actual revolving speed of the prime mover toward the second target revolving speed until start of returning the actual revolving speed of the prime mover toward the first target revolving speed becomes gradually longer, and a shift time from output of the signal for the shift-up from the speed shifter until completion of the shift-action of the switching valve to the second speed position becomes gradually longer.

12. The working machine according to claim 10, wherein when the speed shifter outputs the signal for the shift-up, the controller controls the revolving speed of the prime mover and the shift-action of the switching valve so that as the actual revolving speed of the prime mover detected by the revolving speed detection device at the time when the speed shifter outputs the signal for the shift-up becomes smaller, a revolving speed reduction time from start of reducing the actual revolving speed of the prime mover toward the second target revolving speed until start of returning the actual revolving speed of the prime mover toward the first target revolving speed becomes gradually shorter, and a shift time from output of the signal for the shift-up from the speed shifter until completion of the shift-action of the switching valve to the second speed position becomes gradually shorter.

13. The working machine according to claim 10, wherein the controller does not reduce the actual revolving speed of the prime mover toward the second target revolving speed when the actual revolving speed of the prime mover detected by the revolving speed detection device at the time when the speed shifter outputs the signal for the shift-up is an idling speed or less.

14. The working machine according to claim 10, comprising:

a first traveling device located on a left side of the machine body; and a second traveling device located on a right side of the machine body, wherein the traveling motor includes:

a first traveling motor to provide a traveling power to the first traveling device; and a second traveling motor to provide a traveling power to the second traveling device, the traveling pump is configured to activate the first traveling motor and the second traveling motor, and the switching valve is configured to shift the speeds of rotations of both the first traveling motor and the second traveling motor between the first speed and the second speed.

15. The working machine according to claim 1, wherein the controller is configured or programmed to control a shift-action of the switching valve between the first speed position and the second speed position, and when the speed shifter outputs the signal for the shift-down, the controller starts the shift-action of the switching valve from the second speed position to the first speed position after the actual revolving speed of the prime mover having been reduced to the second target revolving speed starts returning toward the first target revolving speed, and ends the shift-action of the switching valve to the first target revolving speed before the returned actual revolving speed of the prime mover reaches the first target revolving speed.

16. The working machine according to claim 15, wherein when the speed shifter outputs the signal for the shift-down, the controller controls the revolving speed of the prime mover and the shift-action of the switching valve so that as the actual revolving speed of the prime mover detected by the revolving speed detection device at the time when the speed shifter outputs the signal for the shift-down becomes larger, a revolving speed reduction time from start of reducing the actual revolving speed of the prime mover toward the second target revolving speed until start of returning the actual revolving speed of the prime mover toward the first target revolving speed becomes gradually longer, and a shift time from output of the signal for the shift-down from the speed shifter until completion of the shift-action of the switching valve to the first speed position becomes gradually longer.

17. The working machine according to claim 15, wherein when the speed shifter outputs the signal for the shift-down, the controller controls the revolving speed of the prime mover and the shift-action of the switching valve so that as the actual revolving speed of the prime mover detected by the revolving speed detection device at the time when the speed shifter outputs the signal for the shift-down becomes smaller, a revolving speed reduction time from start of reducing the actual revolving speed of the prime mover toward the second target revolving speed until start of returning the actual revolving speed of the prime mover toward the first target revolving speed becomes gradually shorter, and a shift time from output of the signal for the shift-down from the speed shifter until completion of the shift-action of the switching valve to the first speed position becomes gradually shorter.

18. The working machine according to claim 15, wherein the controller does not reduce the actual revolving speed of the prime mover toward the second target revolving speed when the actual revolving speed of the prime mover detected by the revolving speed detection device at the time when the speed shifter outputs the signal for the shift-down is an idling speed or less.

19. The working machine according to claim 15, wherein the controller does not reduce the actual revolving speed of the prime mover toward the second target revolving speed when the speed shifter outputs the signal for the shift-down while the machine body stops.

20. The working machine according to claim 15, comprising:

a first traveling device located on a left side of the machine body; and a second traveling device located on a right side of the machine body, wherein the traveling motor includes:

a first traveling motor to provide a traveling power to the first traveling device; and a second traveling motor to provide a traveling power to the second traveling device, the traveling pump is configured to activate the first traveling motor and the second traveling motor, and the switching valve is configured to shift the speeds of rotations of both the first traveling motor and the second traveling motor between the first speed and the second speed.

* * * * *